United States Patent [19]

Fagg

[11] Patent Number: 5,065,775

[45] Date of Patent: Nov. 19, 1991

[54] TOBACCO PROCESSING

[75] Inventor: Barry S. Fagg, Winston-Salem, N.C.

[73] Assignee: R. J. Reynolds Tobacco Company, Winston-Salem, N.C.

[21] Appl. No.: 484,587

[22] Filed: Feb. 23, 1990

[51] Int. Cl.[5] ..... A24B 15/24; A24B 15/26

[52] U.S. Cl. ..... 131/297; 131/298; 131/352; 131/356; 131/310

[58] Field of Search ..... 131/310, 297, 298, 352, 131/356

[56] References Cited

U.S. PATENT DOCUMENTS

| | | |
|---|---|---|
| 678,362 | 7/1901 | Froehling . |
| 802,487 | 10/1905 | Wimmer . |
| 1,196,184 | 8/1916 | Villiers-Stuart . |
| 1,294,310 | 2/1919 | Sayre et al. . |
| 1,949,012 | 2/1934 | Frank . |
| 2,128,043 | 8/1938 | Garner . |
| 2,227,863 | 1/1941 | Rhodes . |
| 2,582,075 | 1/1952 | Severi . |
| 2,770,239 | 11/1956 | Prats et al. . |
| 2,805,667 | 9/1957 | Von Bethmann . |
| 2,822,306 | 2/1958 | Thienemann et al. . |
| 3,046,997 | 7/1962 | Hind . |
| 3,096,773 | 7/1963 | Neukomm et al. . |
| 3,139,435 | 6/1964 | Staley et al. . |
| 3,390,685 | 7/1968 | Von Bethmann et al. . |
| 3,396,735 | 8/1968 | Von Bethmann et al. . |
| 3,561,451 | 2/1971 | Jacin et al. . |
| 4,068,671 | 1/1978 | Casey . |
| 4,153,063 | 5/1979 | Roselius et al. . |
| 4,744,375 | 5/1988 | Denier et al. . |
| 4,962,774 | 10/1990 | Thomasson et al. . |

FOREIGN PATENT DOCUMENTS

| | | |
|---|---|---|
| 280817 | 9/1988 | European Pat. Off. . |
| 323699 | 7/1989 | European Pat. Off. . |

*Primary Examiner*—V. Millin

[57] ABSTRACT

Denicotinized tobacco cut filler is provided by (i) providing an aqueous denicotinized tobacco extract, (ii) providing tobacco cut filler which has been extracted with an aqueous liquid, (iii) contacting the aqueous extract with the extracted cut filler, (iv) deliquoring the mixture of aqueous extract and extracted cut filler such that a certain level of the tobacco extract remains in contact with the extracted cut filler, and (v) drying the deliquored cut filler to provide a processed cut filler. Greater than 90 percent of the nicotine present in tobacco cut filler can be removed therefrom using such process steps.

41 Claims, 4 Drawing Sheets

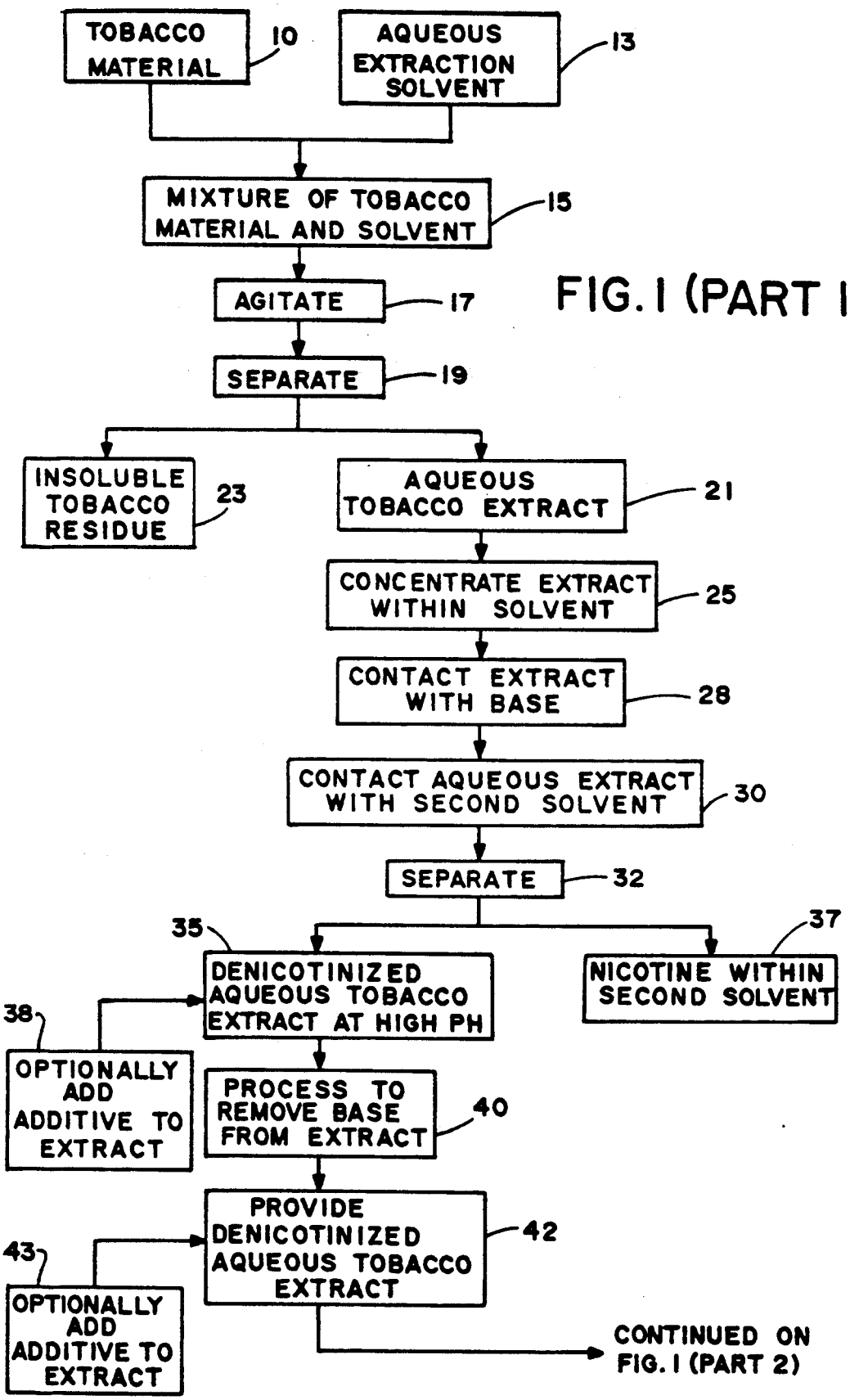
FIG. 1 (PART 1)

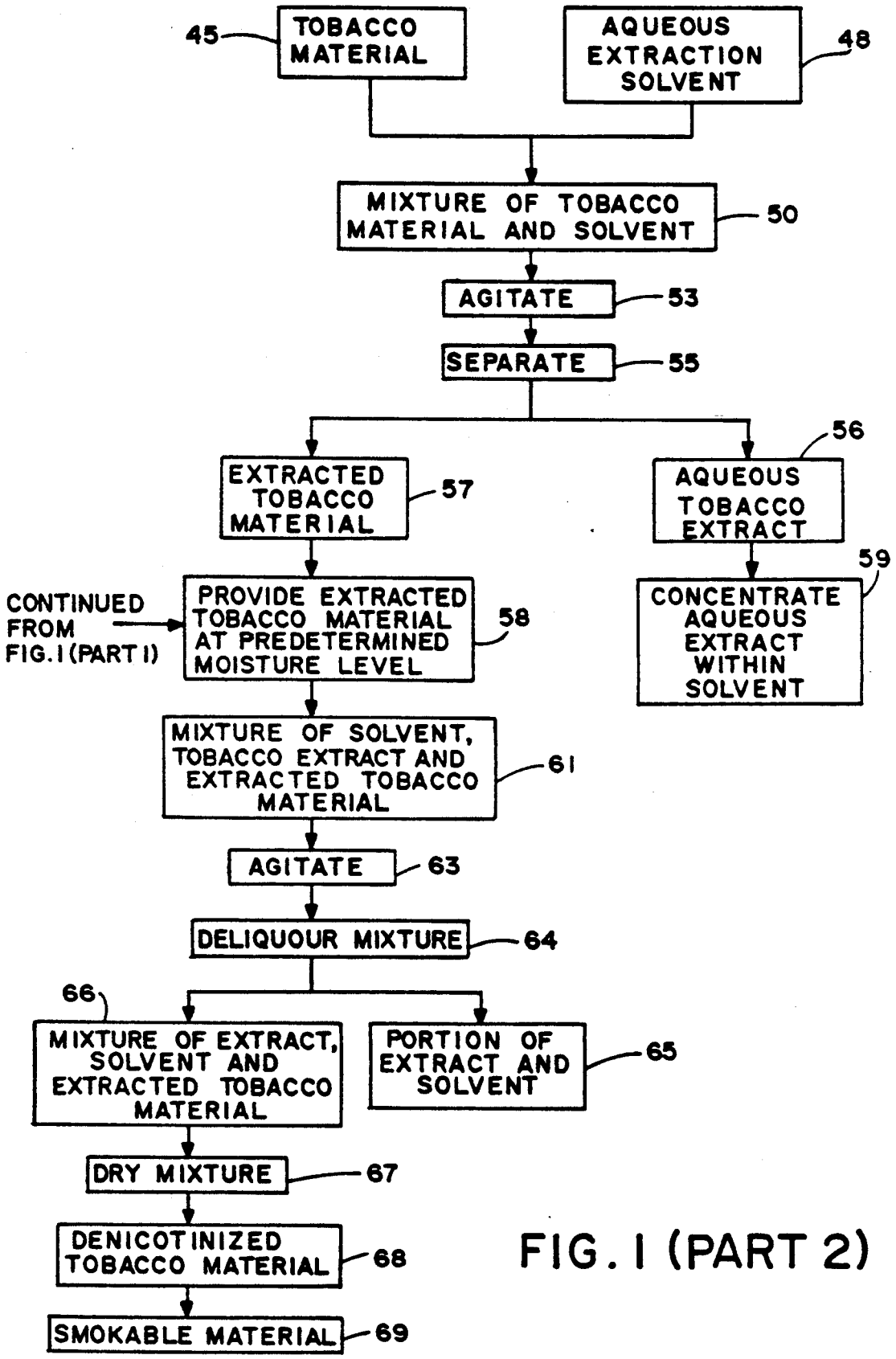
FIG. 1 (PART 2)

TOBACCO PROCESSING

BACKGROUND OF THE INVENTION

The present invention relates to tobacco, and in particular to a process for changing the character of a tobacco material.

Popular smoking articles, such as cigarettes, have a substantially cylindrical rod shaped structure and include a charge of smokable material, such as shreds or strands of tobacco material (i.e., in cut filler form), surrounded by a paper wrapper, thereby forming a tobacco rod. It has become desirable to manufacture a cigarette having a cylindrical filter element aligned in an end-to-end relationship with the tobacco rod. Typically, a filter element includes cellulose acetate tow circumscribed by plug wrap, and is attached to the tobacco rod using a circumscribing tipping material.

Tobacco undergoes various processing steps prior to the time that it is used for cigarette manufacture. Oftentimes, tobacco is chemically or physically treated to modify flavor and smoking characteristics thereof. In certain circumstances, it may be desirable to selectively remove components, such as nicotine, from tobacco. Various processes directed toward removing nicotine from tobacco have been proposed. Many of such types of processes are discussed in European Patent Application No. 280817 and U.S. Pat. No. 4,744,375 to Denier et al. Another process for removing nicotine from tobacco is described in European Patent Application No. 323699.

It would be desirable to provide a process for efficiently and effectively altering the chemical nature or composition of tobacco, and in particular to provide a process for removing selected components from a tobacco material.

SUMMARY OF THE INVENTION

The present invention relates to a process for changing the character of a tobacco material. In particular, the process involves removing and then redistributing certain components of a tobacco material within that tobacco material, preferably without changing many of the physical characteristics of the tobacco material to a significant degree. In a highly preferred embodiment, the process involves altering the chemical nature of a tobacco material (e.g., by removing at least one selected component from a tobacco material and/or by adding at least one selected substance to that tobacco material).

In one aspect, the process of the present invention involves providing extracted tobacco material by extracting tobacco material using an extraction solvent. The extracted tobacco material is the portion of the tobacco material insoluble in the solvent, and that material is separated from the solvent and tobacco extract extracted by the solvent. The process also involves providing a tobacco extract by extracting tobacco material using an extraction solvent. The chemical composition of the tobacco extract then most desirably is altered so as to provide a processed tobacco extract. In a highly preferred embodiment, the processed tobacco extract is provided by removing at least one selected tobacco component from the extract and/or by adding at least one selected substance to the extract. The tobacco extract, extraction solvent and extracted tobacco material are contacted with one another. Normally, the tobacco extract is provided within extraction solvent, and the extract and solvent are contacted with the extracted tobacco material. As such, there is provided a resulting mixture of (i) solvent, (ii) tobacco extract, and (iii) extracted tobacco material. The weight of the solvent within the mixture is more than 3 times that of the weight of the extracted tobacco material within the mixture. The extracted tobacco material is separated from a predetermined portion of the tobacco extract and solvent; and the resulting mixture of solvent, tobacco extractables and extracted tobacco material normally has a solvent content of at least about 60 percent, based on the total weight of the mixture. At least a portion of the solvent then is separated from the resulting mixture.

In another aspect, the process of the present invention involves providing extracted tobacco material and tobacco extract, as described previously. The process also involves contacting the tobacco extract, extraction solvent and extracted tobacco material with one another in order to provide a mixture of (i) solvent, (ii) tobacco extract, and (iii) extracted tobacco material. The mixture includes an amount of extract having a weight greater than that weight of the extract previously separated from the tobacco material. The mixture normally includes about 5 to about 40 percent tobacco extract extractables (e.g., tobacco extract), based on the total weight of tobacco extractables and solvent within the mixture. The extracted tobacco material is separated from a predetermined portion of the tobacco extract and solvent; and the resulting mixture of solvent, tobacco extractables and extracted tobacco material normally has a solvent content of about 60 to about 90 percent, based on the total weight of the mixture. At least a portion of the solvent then is separated from the resulting mixture.

The process steps of the present invention preferably further involve extracting a yet further amount of tobacco material using extraction solvent, to provide a yet further amount of extracted tobacco material and a further amount of tobacco extract within the solvent. In the preferred embodiment, the chemical composition of the further amount of tobacco extract is altered so as to provide a processed extract; and the processed extract is contacted with the tobacco extract and solvent separated from the previously processed extracted tobacco material. The resulting processed tobacco extract within extraction solvent then is contacted with the yet further amount of extracted tobacco material to provide a mixture of (i) solvent, (ii) tobacco extract, and (iii) extracted tobacco material. Such mixture includes solvent, tobacco extractables and extracted tobacco material in amounts which have been set forth previously. As such, the process steps can continue in order to alter the chemical composition of an indefinite amount (i.e., an indefinite number of lots) of tobacco material.

The present invention, in one specific aspect, relates to a process for modifying the alkaloid content of a tobacco material, and in particular, for providing a processed tobacco material having a controlled nicotine content. For example, the process can be employed to lower the nicotine content of a tobacco material. Such a process involves providing an extracted tobacco material by extracting tobacco material with an extraction solvent having an aqueous character (e.g., water), and separating the tobacco material insoluble in the solvent from the resulting aqueous tobacco extract. The process also involves providing a denicotinized tobacco extract by removing nicotine from an aqueous tobacco extract.

The denicotinized tobacco extract is provided within extraction solvent and contacted with extracted tobacco material. As such, there is provided a slurry of an aqueous tobacco extract and a water insoluble tobacco material. The slurry normally includes about 5 to about 40 percent tobacco extract (i.e., tobacco extractables), based on the total weight of the solvent and tobacco extract within the slurry. The water insoluble tobacco material is separated from a predetermined portion of the solvent and tobacco extract (i.e., the slurry is "deliquored" to remove a certain amount of aqueous tobacco extract from the insoluble portion while providing a moist mixture of insoluble tobacco material and tobacco extract). Then, at least a portion of the extraction solvent is separated from the deliquored portion (i.e., the moist mixture of water insoluble tobacco material and tobacco extract is dried to a desired moisture level). Normally, the level of tobacco extract within extraction solvent is such that, when the slurry is deliquored, a predetermined amount of tobacco extract remains in contact with the insoluble tobacco material so that, when dried to the desired moisture level, the resulting mixture of tobacco extract and insoluble tobacco material has a dry weight essentially equal to that of the tobacco material prior to the time that such tobacco material was subjected to extraction conditions but adjusted for the weight of the substance(s) removed from the tobacco material during the process steps of the present invention.

In a highly preferred embodiment of the present invention, the tobacco extract has selected substance(s) removed therefrom by contacting liquid extraction solvent containing the tobacco extract (i.e., an extract/extraction solvent mixture) with a second liquid solvent. The second solvent is immiscible with the extract/extraction solvent mixture, and selected substance(s) within the extract/extraction solvent mixture are transferred to within the second solvent. The processed tobacco extract/extraction solvent mixture then is separated from the second solvent that includes the selected substance(s) removed from the tobacco extract.

In a preferred process for denicotinizing tobacco, an aqueous liquid extraction solvent containing an aqueously extracted tobacco extract (i.e., an aqueous tobacco extract) is adjusted to a pH of greater than about 9, and contacted with a second liquid solvent which is (i) immiscible with the aqueous tobacco extract, and (ii) a good solvent for nicotine. After contact has occurred for the desired period under the desired conditions, the aqueous tobacco extract and the second solvent are separated from one another. As such, there is provided an aqueous tobacco extract which is a denicotinized aqueous tobacco extract, and the second solvent containing nicotine.

The process of the present invention provides the skilled artisan with an efficient and effective method for changing the character of a tobacco material (e.g., rearranging components of a tobacco material or altering the chemical nature or composition of a tobacco material) in a controlled manner. That is, the process of the present invention can be employed in a way such that changes in the chemical composition of tobacco can be monitored so as to occur to a desired degree. Preferably, the process involves (i) removing selected substance(s) from a tobacco material, (ii) incorporating controlled amounts of selected substance(s) into a tobacco material, (iii) both removing selected substances from a tobacco material and incorporating selected substances into that tobacco material, or (iv) removing and redistributing tobacco components of a tobacco material in a controlled manner. In particular, significant quantities of selected substance(s), such as nicotine, can be removed from a tobacco material while the removal of other substances from that tobacco material is minimized. A preferred process according to the present invention involves denicotinizing tobacco material (e.g., in cut filler or strip form) such that greater than about 90 percent, preferably greater than about 95 percent, of the nicotine present within the starting tobacco material is removed therefrom. Also of interest is a process whereby a tobacco extract and an extracted tobacco material can be processed separately, and then the processed tobacco extract and processed extracted tobacco material can be contacted with one another to provide a processed tobacco material.

BRIEF DESCRIPTION OF THE DRAWINGS

FIG. 1 is a schematic diagram of the process steps representative of one embodiment of the present invention;

DETAILED DESCRIPTION OF THE PREFERRED EMBODIMENTS

Figure 2:
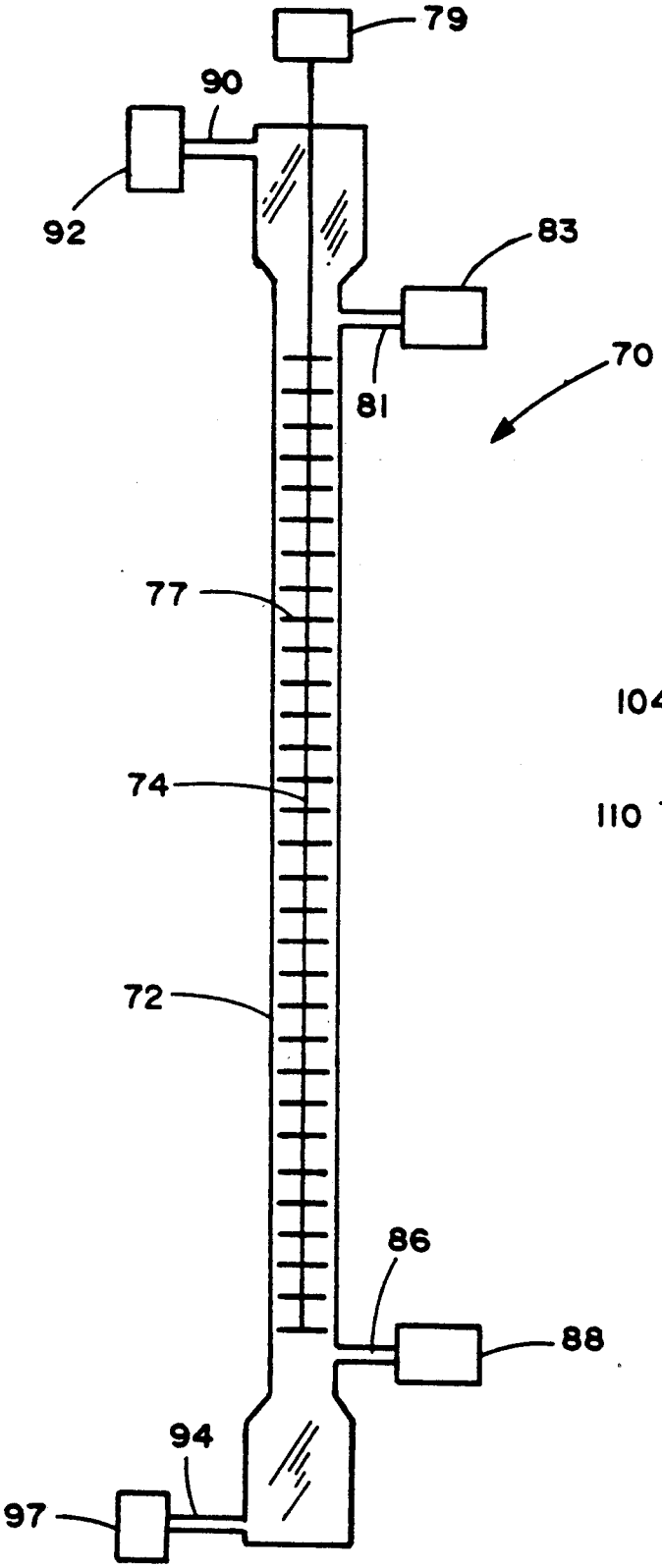
FIG. 2 is a schematic diagram of a representative apparatus for performing certain of the process steps of the present invention.

Referring to FIG. 1, tobacco material 10, such as tobacco dust, cut filler or strip, is contacted with an aqueous extraction solvent 13. Contact can be performed in either a continuous or batch-wise manner. The mixture 15 of tobacco material 10 and extraction solvent 13 can be agitated 17 in order to enhance removal of water soluble components from the tobacco material. The mixture 15 is subjected to separation conditions 19 (e.g., using a centrifuge) so as to provide an aqueous tobacco extract 21 (i.e., a water soluble tobacco extract within the extraction solvent), and a water insoluble tobacco residue 23. Optionally, the aqueous tobacco extract 21 is concentrated 25 to an appropriate dissolved tobacco solids level using a thin film evaporator, or the like. Furthermore, the aqueous tobacco extract optionally can be spray dried for handling reasons, and then redissolved in water for further processing steps.

Although the pH of the aqueous tobacco extract 21 depends upon factors such as the particular tobacco material 10 which is extracted and the concentration of the extract within the solvent, the aqueous tobacco extract normally exhibits a pH below about 6. The aqueous tobacco extract is contacted with ammonia 28 (e.g., as ammonium hydroxide or gaseous ammonia) to increase the pH of the aqueous tobacco extract to about 9 or above, most preferably to about 10 or above. The aqueous tobacco extract having an increased pH due to the added ammonia 28 is contacted with a second solvent 30, such as monofluorotrichloromethane (i.e., a good solvent for nicotine), such that nicotine is transferred from the aqueous tobacco extract to within the second solvent. The two solvents and extracted substances therein then are separated 32 from one another. As such, there is provided (i) a denicotinized aqueous tobacco extract 35, and (ii) a nicotine-containing second solvent 37. Optionally, selected additives 38, such as glycerin, can be incorporated into the denicotinized extract 35 to further alter the chemical composition of the extract.

The denicotinized aqueous tobacco extract 35 is processed further 40 to remove a substantial portion of the ammonia therefrom. For example, the aqueous extract 35 is spray dried (i.e., to evaporate aqueous solvent and ammonia, and provide a powdered spray dried extract); or distilled (i.e., under conditions to evaporate ammonia); and, as such, remove essentially all or a significant portion of the added ammonia from the extract.

The denicotinized tobacco extract which is processed so as to have added ammonia removed therefrom is contacted with sufficient aqueous extraction solvent so as to provide a denicotinized aqueous tobacco extract 42. A particularly preferred amount of processed denicotinized extract within an aqueous extraction solvent is an amount which ranges from about 15 to about 25 weight percent extract (e.g., dissolved tobacco solids), based on the total weight of the tobacco extract and solvent. Optionally, selected additives 43 can be incorporated into the denicotinized aqueous tobacco extract to further alter the chemical composition of the extract.

A further amount (i.e., a new lot) of tobacco material 45, such as tobacco cut filler or strip, is contacted with an aqueous extraction solvent 48. Contact can be performed in either a continuous or batch-wise manner. The mixture 50 of tobacco material 45 and extraction solvent 48 can be agitated 53 in order to enhance extraction of water soluble components from the tobacco material. The mixture 50 is subjected to separation conditions 55 (e.g., using a centrifuge) so as to provide an aqueous tobacco extract 56 and an extracted tobacco material 57 (e.g., a water insoluble tobacco residue). The extracted tobacco material 57 can be provided at a predetermined moisture level 58 by deliquoring the mixture to a predetermined degree and/or by drying moist extracted tobacco material which has been separated from a substantial portion of the aqueous tobacco extract. Optionally, the aqueous tobacco extract 56 is concentrated to an appropriate dissolved tobacco solids level 59.

The extracted tobacco material 57, which has a very low content of tobacco water solubles (i.e., tobacco extractables), then is contacted with the processed denicotinized aqueous extract 42 so as to provide a mixture 61 (e.g., slurry) of tobacco extract, solvent and tobacco material insoluble in the solvent. The aqueous tobacco extract of the resulting mixture 61 includes components of the denicotinized tobacco extract and components of the extracted tobacco material 57. Normally, the weight of the solvent within the mixture 61 is more than about 10 times that weight of the extracted tobacco material within the mixture. The mixture 61 of extracted tobacco material, extract (i.e., extractables) and extraction solvent can be agitated 63 in order to enhance uniform contact of water soluble tobacco extract components with the extracted tobacco material, while preferably minimizing degradation of the water insoluble extracted tobacco material.

Contact of the mixture 61 of extract, extracted tobacco material and solvent is effected until the extract has had sufficient contact time with the extracted tobacco material. For example, in a batch process, the amount of extract and solvent is sufficiently great relative to the extracted tobacco material such that the extracted tobacco material is provided with the ability to experience fairly uniform contact with the extract.

After contact of the mixture 61 of tobacco material, extract and solvent is complete, the mixture is deliquored 64. For example, the mixture is squeezed or pressed to remove a certain portion 65 of the extract and solvent (i.e., aqueous extract) therefrom. The resulting moist mixture of extract and water insoluble tobacco material 66 is such that the dry weight thereof is essentially equal to that of the dry weight of the tobacco material 45 prior to processing steps of the present invention minus the weight of the nicotine and other tobacco components which are removed therefrom plus the weight of any additives which are added thereto.

The deliquored tobacco material is subjected to a drying operation 67 so as to yield a denicotinized tobacco material 68 having a moisture content of about 10 to about 15 weight percent. Typically, the denicotinized tobacco material 68 exhibits an ammonia content of less than about 1 weight percent, more preferably less than about 0.5 weight percent. The resulting denicotinized tobacco material 68 is used as smokable material 69 for the manufacture of cigarettes. For example, the denicotinized tobacco material can be cased, top dressed, further processed or treated (e.g., volume expanded), screened to provide material of the desired size, and/or blended with other smokable materials.

Referring to FIG. 2, there is shown an apparatus 70 for performing certain preferred process steps of the present invention. Such an apparatus is known to the skilled artisan as a Karr Reciprocating Plate Extraction Column. See, Karr, *A. I. Ch. E. Journ.*, Vol. 5, p. 446 (1959). The apparatus 70 includes a long, slender tube or column 72 which is positioned such that the longitudinal axis thereof is in an essentially vertical plane. Essentially coaxially with the longitudinal axis of the column is inserted a shaft 74 which supports a plurality of extraction plates 77 spaced at intervals along the shaft. The plates 77 preferably are positioned perpendicularly to the shaft 74. The shaft is supported by a variable speed drive agitator 79 or other such means which moves the shaft (and hence the series of plates) periodically up and down. The column 72 includes an upper input region or nozzle 81 into which the second (e.g., heavy) liquid solvent is fed continuously from source 83. The column also includes lower input region 86 or nozzle into which the liquid aqueous tobacco extract is fed continuously from source 88.

The shaft 74 (and hence the plates 77) is reciprocated at a rate sufficient to provide adequate contact of the two liquids but at a sufficiently low rate so as to minimize or eliminate undesirable emulsion formation between the two liquids. The raffinate (e.g., the denicotinized aqueous tobacco extract which has been contacted with the second solvent) exits the column 72 at output region 90 and is collected in reservoir 92. The second solvent and selected substance(s) transferred from the extraction solvent exit the column at output region 94, and are collected in reservoir 97.

Figure 3:
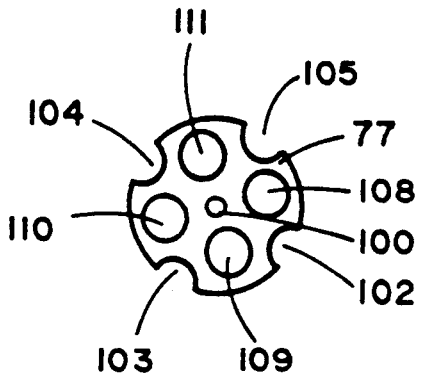
FIG. 3 is an enlarged view of a component of the apparatus shown in FIG. 2.

Referring to FIG. 3, there is shown an end view of a representative extraction plate 77 taken along the longitudinal axis of the column shown in FIG. 2. The spacer 77 has a diameter which approximates the inner diameter of the column. The plate has an opening 100, through which the shaft extends. The plate also includes a series of peripheral openings 102, 103, 104 and 105 as well as inner openings 108, 109, 110 and 111, such that the liquids can pass therethrough. Normally, the plate is manufactured from a metal such as stainless steel, a polymeric material such as Teflon, or the like.

Figure 4:
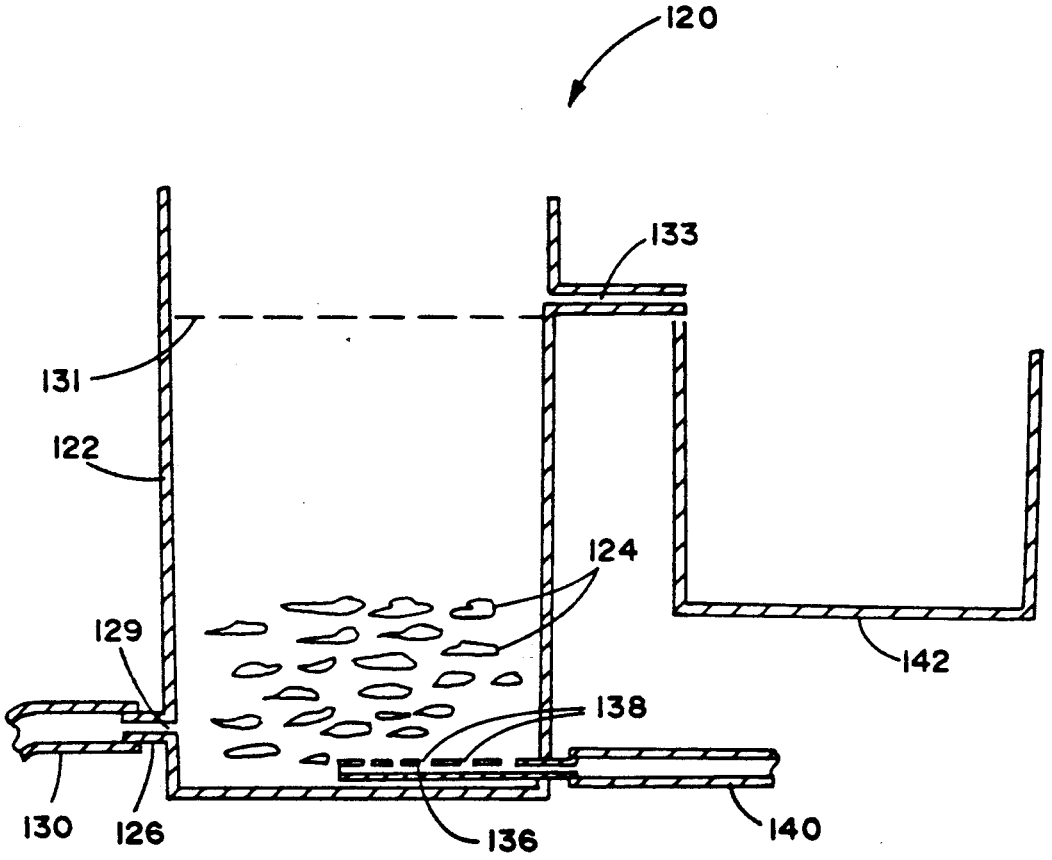
FIG. 4 is a cross-sectional view of a representative apparatus for performing certain process steps of the present invention.

Referring to FIG. 4, there is shown an apparatus 120 for performing certain process steps of the present invention. Container 122 has side walls and a bottom wall, and contains tobacco material 124 to be extracted. Into bottom feed port 126 is fed a solvent having an aqueous character 129, which in turn, contacts the tobacco material 124. The solvent is fed from a reservoir (not shown) through tube 130 (shown as cut away) using a suitable pump (not shown). Screen 131 is positioned over the tobacco material but below exit port 133 in order to prevent insoluble tobacco material from exiting the container. A tube or plenium 136 having a plurality of perforations 138 therein is connected to air line 140 (shown as cut away) from an air source (not shown) to provide agitation by a bubbling action to the mixture (i.e., slurry) of tobacco material and solvent. As such, the tobacco material 124 is subjected to contact with the solvent under extraction conditions. Aqueous tobacco extract which exits the exit port 133 is collected in reservoir 142 (not shown to scale), is later processed (e.g., to remove nicotine therefrom), and can be used for later contact with an extracted tobacco material. If desired, several apparatus 120 can be provided in series so that aqueous tobacco extract exiting one container containing tobacco material can be contacted with tobacco material in another container.

The apparatus 120 provides a convenient means for continuously contacting a supply of an aqueous solvent with a sample of tobacco material. In particular, solvent can be continuously passed through container 122 containing tobacco material 124 at a desired rate until the resulting mixture of aqueous tobacco extract and tobacco material exhibits a desirably low tobacco extract content. Then, the resulting extracted tobacco material can be removed from the container (i.e., the extracted tobacco material is separated from the aqueous tobacco extract). Alternatively, the apparatus 120 can be employed to provide a batch-wise contact of a solvent with a sample of tobacco material. In particular, solvent can be recirculated through the container 122 containing a suitable amount of tobacco material 124.

The tobacco material which is processed according to the process of the present invention can vary. The tobacco materials which are used are of a form such that, under extraction conditions, a portion thereof is soluble in (i.e., extracted by) the extraction solvent and a portion thereof is insoluble in (i.e., not extracted by) the extraction solvent. Examples of types of suitable tobacco materials include flue-cured, Burley, Maryland, and Oriental tobaccos, as well as the rare or specialty tobaccos. Normally, the tobacco material has been aged. The tobacco material can be in the form of laminae and/or stem, or can be in a processed form. For example, the tobacco material can be in the form of whole leaf, strip, cut filler, processed stem, volume expanded tobacco filler, reconstituted strip or filler, or tobacco previously extracted to a certain degree. Tobacco waste materials and processing by-products (e.g., scrap and dust) also can be employed. The aforementioned tobacco materials can be processed separately, or as blends thereof.

The tobacco material can have a variety of sizes for extraction. The tobacco material most preferably is in strip form or cut filler form. Tobacco materials in strip or cut filler form are desirable in that the ultimately processed tobacco materials are employed as such for the manufacture of cigarettes. Tobacco scrap, stems and dust also can be extracted according to the process of the present invention, and the resulting processed tobacco material can be formed into a predetermined (e.g., sheet-like) shape, thus providing a reconstituted tobacco material.

The tobacco material is contacted with an extraction solvent. A highly preferred extraction solvent is a solvent having an aqueous character. Such a solvent consists primarily of water, is normally greater than 90 weight percent water, and can be essentially pure water in certain circumstances. Essentially pure water can include deionized water, distilled water or tap water. The extraction solvent can be a co-solvent mixture, such as a mixture of water and minor amounts of one or more solvents which are miscible therewith. An example of such a co-solvent mixture is a solvent consisting of 95 weight parts water and 5 weight parts ethanol. The extraction solvent also can include water having substances such as pH adjusters (i.e., acids or bases) or pH buffers dissolved therein. For example, an aqueous solvent can have ammonium hydroxide or gaseous ammonia incorporated therein so as to provide a solvent having a pH of about 8 or more.

The amount of tobacco material which is contacted with the extraction solvent can vary. Typically, for a batch-wise extraction, the weight of extraction solvent relative to the tobacco material is greater than about 6:1, oftentimes greater than about 8:1 and in certain instances greater than about 12:1. The amount of solvent relative to tobacco material depends upon factors such as the type of solvent, the temperature at which the extraction is performed, the type or form of tobacco material which is extracted, the manner in which contact of the tobacco material and solvent is conducted, the type of extraction process which is performed, and other such factors. The manner for contacting the tobacco material with the extraction solvent is not particularly critical, and as such, the tobacco material can be extracted in either a continuous or batch-wise manner. For example, the tobacco material can be extracted using a continuous counter current extractor.

Tobacco material can be extracted in a batch-wise manner one or more times using the solvent. Normally, the weight of extract and solvent relative to the weight of tobacco material for each batch extraction ranges from about 6:1 to about 40:1, preferably from about 15:1 to about 25:1. The number of times that the tobacco material is contacted batch-wise with the processed tobacco extract and solvent ranges from about 1 to about 8 times, preferably about 3 to about 5 times. For example, tobacco material in cut filler form can be contacted batch-wise at ambient temperature (i.e., about 22° C.) with three successive portions of an aqueous solvent, and the resulting mixture is subjected to a deliquoring step to provide a moist mixture of insoluble tobacco material and tobacco extract of about 78 weight percent after contact of each successive portion is complete; and after the third deliquoring step, the moist tobacco material can be dried to a moisture level of about 10 to about 15 weight percent so as to provide a tobacco cut filler having undergone a reduction in water soluble tobacco components of about 96 weight percent.

Tobacco material can be extracted continuously using a solvent. Normally, the weight of solvent relative to the tobacco material with which it is contacted during a continuous extraction process is greater than about 40:1, preferably greater than about 50:1.

The conditions under which the extraction is performed can vary. Typical temperatures range from about 5° C. to about 75° C., with about 10° C. to about 60° C. being preferred, about 15° C. to about 35° C. being more preferred, and ambient temperature being particularly preferred. The solvent/tobacco material mixture can be agitated (e.g., stirred, shaken or otherwise mixed) in order to increase the rate at which extraction occurs. Typically, for a batch-wise extraction, adequate extraction of components occurs in less than about 60 minutes, oftentimes in less than about 30 minutes.

A wide variety of components can be extracted from the tobacco materials. The particular components and the amounts of the particular components which are extracted often depend upon the type of tobacco which is processed, the properties of the particular solvent, and the extraction conditions (e.g., which include the temperature at which the extraction occurs as well as the time period over which an extraction is carried out). For example, an extraction solvent consisting essentially of pure water will most often extract primarily the water soluble components of the tobacco material, while a co-solvent mixture of water and a minor amount of an alcohol can extract the water soluble components of the tobacco material as well as certain amounts of tobacco substances having other solubility characteristics. Water soluble tobacco components which are extracted from a tobacco material using a solvent having an aqueous character include alkaloids, acids, salts, sugars, and the like. Water soluble extracted tobacco components include many of the flavorful substances of the tobacco material.

The extraction solvent and tobacco extract then are separated from the insoluble tobacco residue. The manner of separation can vary; however, it is convenient to employ conventional separation techniques involving the use of filters, centrifuges, screw presses, converging belts, rotating disk presses, and the like. Preferably, the insoluble residue is treated so as to remove a predetermined amount of solvent and tobacco extract therefrom. The insoluble residue provided during the collection of the extract is not necessarily used in further stages of the process, and may be discarded.

The solvent and tobacco components extracted thereby can be filtered to remove suspended insoluble particles; concentrated; diluted with solvent; or spray dried, freeze dried, or otherwise processed, particularly for storage or handling reasons. Dried extracts, such as spray dried tobacco extracts, can be later redissolved in extraction solvent for later treatment and further extraction process steps.

The chemical composition of the tobacco extract is altered so as to provide a processed extract, and a variety of techniques can be employed to alter the chemical composition of the tobacco extract. For example, the tobacco extract can be heat treated; processed to remove nicotine, nitrates or other such components therefrom; provided within solvent and subjected to membrane treatment to remove certain soluble or dispersible components (e.g., as set forth in U.S. patent application Ser. No. 358,725, filed May 30, 1989); or contacted with at least one additive including casing materials (e.g., glycerin or propylene glycol), top dressing materials, organic acids (e.g., citric, ascorbic, malic, tartaric, lactic, acetic, succinic or malonic acids), monoammonium phosphate, diammonium phosphate, ammonia, sugars (e.g., sucrose, dextrose, glucose or fructose), amino acids, hydrolyzed amino acids, metal ions (e.g., types and amounts sufficient to alter the combustion properties of the ultimate processed tobacco material), or combinations thereof. The types and amounts of additives which are incorporated into a particular tobacco extract can vary, depending upon the desired nature of the ultimate tobacco material which is processed, and the types and amounts of additives employed can be determined by experimentation. If desired, certain components can be removed from the tobacco extract and certain selected additives can be incorporated into the tobacco extract. If desired, a tobacco extract within extraction solvent can be subjected to ion exchange, adsorption or further extraction treatments. In a preferred aspect, an aqueous tobacco extract is subjected (i) to liquid/liquid extraction processing steps, (ii) to supercritical extraction processing steps, as described in European Patent Application No. 338,831, which is incorporated herein by reference, or (iii) to further treatment as set forth in European Patent Application No. 326,370, which is incorporated herein by reference. Methods for removing nitrates from tobacco extracts (e.g., for removing potassium nitrate from a Burley extract) will be apparent to the skilled artisan. See, U.S. Pat. No. 4,131,117 to Kite et al.

For an aqueous tobacco extract, the pH thereof can be altered. The pH of the aqueous tobacco extract can be raised to promote removal of basic compounds therefrom, lowered to promote removal of acidic compounds therefrom, or made neutral to promote removal of neutral compounds therefrom. For example, the pH of the aqueous tobacco extract can be raised so as to enhance the removal of alkaloids, such as nicotine, therefrom upon contact with a second solvent which is a good solvent for the alkaloids. Typically, for certain processes, the pH of the aqueous tobacco extract is altered so as to be about 7 or more, frequently about 8 or more, and occasionally about 9 or more. For maximum removal of nicotine, the pH of the aqueous tobacco extract is altered so as to be about 10 or more. Preferred basic materials for raising the pH of the aqueous tobacco extract include gaseous ammonia and ammonium hydroxide. Other agents for altering the pH of the extraction solvent and tobacco extract will be apparent to the skilled artisan. It may be desirable to alter the pH of aqueous tobacco extract, perform a liquid/liquid extraction step to remove certain substance(s) from the aqueous extract, collect the resulting aqueous extract, alter the pH of that resulting aqueous extract, and perform a second processing step to remove certain other substance(s) from that aqueous extract. The amount of tobacco extract relative to the amount of extraction solvent during the liquid/liquid extraction step with the second solvent can vary. Although highly concentrated extracts can be employed, the dissolved tobacco components typically present within extraction solvent are less than about 25 weight percent, normally less than about 20 weight percent.

The second solvent can vary. The second solvent can have a gaseous or liquid form. Thus, selected substance(s) can be removed from a tobacco extract within a liquid extraction solvent using either gas/liquid or liquid/liquid separation techniques. An example of a gaseous solvent is an inorganic solvent, such as sulfur hexafluoride. Preferred solvents are employed in a liquid form. Preferably, the second solvent is a halocarbon such as monofluorotrichloromethane (CFC 11) or halogenated hydrocarbon such as dichlorotrifluoroethane (HCFC 123). Other second solvents include the triglycerides. Triglyceride compounds include palm oil, linseed oil, soybean oil, corn oil, and the like. Organic solvents such as pentane, hexane, heptane, n-propyl acetate, ethyl acetate and i-propyl acetate also can be employed. Preferred second solvents are very good solvents for certain selected substances within the tobacco extract, and are immiscible with the extraction solvent. When the Karr Reciprocating Plate Extraction Column is employed, it is particularly desirable that the tobacco extract/extraction solvent mixture and second liquid solvent have densities which are substantially different from one another.

The extract/extraction solvent mixture and second solvent normally are immiscible with one another in the highly preferred aspects of the present invention. By this is meant that the extract/extraction solvent mixture and the second solvent do not have a propensity to mix with one another, and remain in distinct phases upon contact. Preferably, when contacted with one another under conditions at which the liquid/liquid extraction steps are performed, the extract/extraction solvent mixture and second solvent do not emulsify to any significant degree. For many immiscible solvents useful according to this invention, the solubility of the second solvent in the extract/extraction solvent mixture preferably is less than about 1 weight percent, and more preferably less than about 0.5 weight percent, at 20° C.

The extract/extraction solvent mixture is contacted with the second solvent to provide a two phase mixture of liquids. Normally, the temperatures of the two phases are controlled so that both the extract/extraction solvent mixture and second solvent remain below their respective boiling points during the period of contact of the phases. When the second solvent is CFC 11 or HCFC 123, it is desirable to maintain both of the liquids at a temperature below about 20° C. at atmospheric pressure during the time that the two liquids are in contact. Typically, the temperature at which the liquid/liquid extraction is performed is high enough to minimize or eliminate the formation of an emulsion but low enough to minimize or eliminate the vaporization of either or both of the liquids. However, the temperature of the two liquids can be selected so as to provide an optimum transfer of selected substances from within the extraction solvent to within the second solvent.

The two liquids are subjected to conditions sufficient to transfer selected tobacco substance(s) from within the extraction solvent to within the second solvent. For example, certain extracted tobacco components within the extraction solvent may have a preferential solubility in the second solvent. In particular, for an aqueous tobacco extract having a pH of about 10 or more, nicotine and other alkaloids present within the aqueous tobacco extract are preferentially soluble in a second solvent, such as a halocarbon or halogenated hydrocarbon.

After contact of the two liquids is effected, the respective phases are separated from one another. Preferably, the contact of the two liquids occurs under conditions sufficient to provide transfer of a significant amount of the desired tobacco substance(s) from the extraction solvent to the second solvent. Additionally, it is preferable that agitation of the phases during contact thereof be such that emulsion formation is minimized or eliminated. Typically, when a Karr Reciprocating Plate Extraction Column is employed to perform the liquid/liquid extraction process, the lighter phase (e.g., most often the extraction solvent carrying tobacco extract components which remain after contact with the second solvent) preferably exits the upper output region of the column and is collected; and the heavier phase (e.g., most often the denser second solvent carrying selected tobacco substance(s) removed from the extraction solvent) preferably exits the lower output region of the column and is collected. Other apparatus for contacting and/or separating the two solvents and tobacco components extracted thereby (e.g., separation funnels, centrifugal extractors and rotating disc columns) will be apparent to the skilled artisan.

The selected tobacco substance(s) which are carried by the second solvent after the liquid/liquid extraction process normally are separated from the second solvent (i.e., are isolated). Typically, the second solvent is subjected to distillation conditions, and the tobacco components contained therein are collected. Alternatively, when the second solvent has been used to extract nicotine from an aqueous tobacco extract, the second solvent can be subjected to a liquid/liquid extraction process with an acidified aqueous solution to remove the nicotine from the second solvent. The second solvent so treated, essentially absent of tobacco substances, then can be re-employed for further liquid/liquid extraction processing steps.

The tobacco extract which remains within the extraction solvent after the liquid/liquid extraction process can be employed as is, concentrated and employed, diluted with extraction solvent and employed, or separated from the extraction solvent (i.e., isolated). For example, the aqueous extract which is collected after the liquid/liquid extraction process can be freeze dried, spray dried, or the like, so that a great majority of the extraction solvent is removed therefrom. As such, concentrated, processed tobacco extracts in stabilized form can be provided. The concentrated, processed tobacco extract then can be provided within extraction solvent for further use according to the process steps of the present invention.

An aqueous tobacco extract having a relatively high level of added ammonia, and which has been denicotinized using a liquid/liquid extraction process, can have essentially all or part of the added ammonia removed therefrom. For example, the denicotinized aqueous tobacco extract can be subjected to distillation conditions (i.e., under conditions to evaporate ammonia) or spray dried (i.e., so as to evaporate ammonia and water, and hence provide a powdered, spray dried, denicotinized tobacco extract). Distillation and spray drying techniques can vary, and will be apparent to the skilled artisan. Although less preferred, a denicotinized aqueous tobacco extract having a relatively high pH (i.e., due to added ammonia) can be neutralized by contacting the aqueous extract with an effective amount of an acidic substance.

A particularly preferred process for removing ammonia from a denicotinized aqueous tobacco extract involves vacuum distillation of the aqueous extract using a distillation column. Representative distillation columns are described by McCabe and Smith in *Unit Operations of Chemical Engineering,* Chapter 12, (1956). For example, a denicotinized aqueous tobacco extract having a dissolved tobacco solids content of about 10 to about 15 weight percent is introduced into the tenth stage of a distillation column having 15 theoretical stages, and maintained at a pressure of about 300 mm Hg absolute and a temperature of about 80° C. As such, an "overhead distillate" of ammonia and water is removed from the top of the column, and denicotinized aqueous tobacco extract having dissolved tobacco solids content of about 15 to about 25 weight percent and a pH of about 7 is removed from the column as a "bottoms product."

The processed tobacco extract is provided within extraction solvent. As such, a further amount of extraction solvent can be added to the processed tobacco extract, or the processed tobacco extract within extraction solvent can be concentrated. Normally, a predetermined amount of processed tobacco extract (i.e., dissolved tobacco solids) is provided within extraction solvent. The predetermined amount of tobacco extract is such that, when the contact of extracted tobacco material with the tobacco extract and solvent is complete, and a portion of the solvent and tobacco extract is separated therefrom, a predetermined portion of the solvent and tobacco extract remains in contact with the insoluble tobacco portion of the extracted tobacco material.

A processed extract within extraction solvent (e.g., an aqueous denicotinized tobacco extract) normally is provided such that the dissolved tobacco solids within the ultimate mixture of extract, solvent and tobacco material insoluble in the solvent is between about 5 and about 40 percent, preferably between about 8 and about 34 percent, more preferably between about 10 and about 30 percent, most preferably between about 15 and about 25 percent, based on the total weight of the tobacco extractables and solvent. Such an aqueous extract can be contacted with extracted tobacco material, and the insoluble portion of the tobacco material can be deliquored to provide a moist mixture of insoluble extracted tobacco material and tobacco extract having a moisture content of about 60 to about 90 weight percent, preferably about 65 to about 85 weight percent. For example, an aqueous denicotinized tobacco extract can be contacted with extracted tobacco material, and the resulting slurry having a dissolved tobacco solids content of about 18 weight percent is deliquored to a moisture level of about 70 weight percent in order to provide, upon drying (i.e., after removal of moisture), a denicotinized tobacco material having desirable levels of both water insoluble and water soluble tobacco components.

An extracted tobacco material is provided. Normally, the tobacco material which is extracted using extraction solvent to provide the extracted tobacco material has a form such as cut filler or strip, in order that the extracted tobacco material which is provided can be further processed according to the present invention can be employed as such for cigarette manufacture. Manners and methods for extracting tobacco materials are set forth hereinbefore. The tobacco material which is extracted can be one type of tobacco material or a blend of various types of tobacco materials. The extracted tobacco material is the tobacco residue which is not soluble in (i.e., not extracted by) the extraction solvent. Preferably, the tobacco material is subjected to extraction conditions in the presence of sufficient extraction solvent and under conditions sufficient to provide an extracted tobacco material having a high level of the tobacco extractables removed from the tobacco material. The extracted tobacco material is separated from the solvent and tobacco extract to provide an extracted tobacco material having a low level of tobacco extractables. The extracted tobacco material then can be employed in further processing steps of the present invention, or the extracted tobacco material can have a certain amount of the solvent removed therefrom (e.g., the extracted material can be dried, when the solvent has an aqueous character) prior to being employed in further processing steps of the present invention.

If desired, the physical and/or chemical composition of the extracted tobacco material can be altered. The extracted tobacco material can be reformed, cut to a desired size or shape, or otherwise physically altered, particularly when the extracted tobacco material is in a fairly moist form. The extracted tobacco material can be heat treated or otherwise processed to change the chemical composition of that material. In particular, the extracted tobacco material can be subjected to enzyme treatment as set forth in U.S. Pat. No. 4,887,618 to Bernasek et al, reacted with certain agents or further extracted (e.g., an extracted tobacco material provided from an extraction of a tobacco material with an aqueous solvent can be subjected to extraction conditions using a hydrophobic solvent, such as hexane).

The tobacco extract and extraction solvent are contacted with the extracted tobacco material. Contact of the extract and the extraction solvent with the extracted tobacco material can be carried out using the container described previously with reference to FIG. 4, a continuous countercurrent extractor, or other suitable means. As such, components of the tobacco extract contact the tobacco material insoluble in the extraction solvent. If desired, the tobacco extract can be provided from one type of tobacco, and the extracted tobacco material can be provided from another type of tobacco. Normally, extracted components include those substances which are soluble or otherwise dissolve in the solvent, or are highly dispersible within the solvent. During such contact, there exists a dynamic state whereby tobacco components soluble or dispersible in the solvent become dispersed throughout the mixture to some degree. Typically, such contact is performed within a temperature range of about 5° C. to about 75° C., with about 10° C. to about 60° C. being preferred, about 15° C. to about 35° C. being more preferred, and ambient temperature being particularly preferred. Contact conditions are maintained until adequate contact of the extract with the insoluble tobacco material occurs (e.g., there is provided fairly uniform contact of the extract components with the insoluble tobacco material). As such, the components of the extract are well distributed or reestablished within the insoluble tobacco material.

The extracted tobacco material is contacted with an amount of extract and solvent such that not all of that extract and solvent remains in contact with the extracted tobacco material when the final tobacco material is provided. Typically, the weight of solvent contacted with the extracted tobacco material is at least 3 times, frequently at least about 6 times, often at least about 10 times and preferably at least about 15 times that weight of extracted tobacco material within the mixture of solvent, extract and extracted tobacco material.

The extracted tobacco material which has been contacted with the processed tobacco extract and extraction solvent is separated from a portion of the tobacco extract and solvent (e.g., the mixture is deliquored). As such, there is provided a mixture of extraction solvent, extract and tobacco material insoluble in the solvent (e.g., a moist mixture of extract and water insoluble tobacco material, when the solvent is water). The tobacco material insoluble in the solvent can vary, depending upon the solvent and extraction conditions. However, for a solvent having an aqueous character, a typical insoluble tobacco material includes components of the biopolymer matrix of the tobacco (e.g., cellulosics) and other tobacco materials which are not dissolved in the solvent or are not otherwise extracted by the solvent. For purposes of the present invention, insoluble materials are tobacco components not extracted by the particular solvent which is employed under the selected extraction conditions.

Typical deliquoring processes or steps involve using converging belts, centrifuges, screw presses, rotating disk presses, or the like. Typically, the deliquored mixture of tobacco extractables and insoluble extracted material has a solvent content of about 60 to about 90 weight percent, preferably about 65 to about 85 weight percent; particularly when the weight of the solvent within the mixture prior to the deliquoring step is more than about 10 times that weight of the extracted tobacco material within that mixture. The deliquored mixture of tobacco extractables and insoluble extracted tobacco material can be dried using hot air columns, apron dryers, microwave dryers, or the like. Typically, deliquored tobacco material is dried to a moisture level of about 10 to about 15 weight percent, preferably about 12 to about 13 weight percent.

The processed tobacco material, which has had a desired amount of solvent removed therefrom, can be further processed prior to the time that it is used for the manufacture of cigarettes or other smoking articles. In particular, processed tobacco material in strip form and having a fairly high moisture content can be shredded into cut filler form using known techniques, and then dried for further use. The processed tobacco material can be volume expanded using known techniques, particularly when the processed tobacco material is in cut filler form. The processed tobacco material can be subjected to reconstitution processing steps (e.g., using known papermaking, cast sheet or extrusion techniques), particularly when the processed tobacco material is in the form of dust, fines, stem and/or scrap. The processed tobacco material can be cased, top dressed, or otherwise treated in order to alter the flavor or smoking characteristics thereof. The processed tobacco material then can be used as the smokable filler material for the manufacture of cigarettes, or blended with other smokable materials for the manufacture of cigarettes.

Tobacco extract and extraction solvent which are contacted with the extracted tobacco material (i.e., the extract and solvent separated from the tobacco material, including the portion separated during the deliquoring step) are collected. Although not necessary, the extract so collected can be processed to remove certain substance(s) therefrom, have certain additives applied thereto, and/or provided at a desired dissolved solids level with extraction solvent. If desired, further solvent and further processed extract can be incorporated into the extract and solvent which is collected, in order to provide a tobacco extract and solvent mixture having a desired, predetermined tobacco extract level. As such, a processed extract is regenerated for use in altering the chemical composition of a further lot of extracted tobacco material.

The following examples are provided in order to further illustrate various embodiments of the invention, but should not be construed as limiting the scope thereof. Unless otherwise noted, all parts and percentages are by weight.

EXAMPLE 1

A process for producing a very low nicotine content tobacco material by selectively removing nicotine from an aqueous tobacco extract is performed as follows:

An aged blend of 49.25 parts flue-cured, 28.5 parts Burley and 22.25 parts Oriental tobaccos, in cut filler form shredded at 32 cuts per inch, and having a dry weight nicotine content of about 2.3 percent and a dry weight water soluble portion of about 50 percent, is divided into lots or portions. One lot is retained for later use. The other lot is extracted in a stainless steel tank at a concentration of about 24 kg of tobacco per cubic meter of tap water. The extraction is conducted at ambient temperature (e.g., about 60° C.) while mechanically agitating the mixture over about a 1 hour period. The admixture (i.e., an aqueous tobacco extract and an insoluble portion) is distributed on a belt washer to remove aqueous extract from the insoluble portion. The aqueous extract is concentrated in a thin film evaporator to a concentration of about 30 percent dissolved solids. Thin film evaporation conditions are such that water is evaporated from the extract while loss of tobacco volatiles is minimized. The concentrated aqueous extract then is spray dried by continuously pumping the aqueous solution to an Anhydro Size No. 1 spray dryer. The dried powder is collected at the outlet of the dryer. The inlet temperature of the spray dryer is about 215° C., and the outlet temperature is about 80° C.

The spray dried tobacco extract is a brown, powdery material, and has a moisture content of about 5 to about 10 percent, and a nicotine content of about 4.6 percent. Spray drying allows the tobacco extract to be stored for further use.

The spray dried extract then is contacted with warm tap water in the amount of about 18 parts extract to about 82 parts tap water. The resulting aqueous tobacco extract, which exhibits a pH of about 5, is filtered to remove suspended particulate matter therefrom. To the solution is added a sufficient amount of a solution of aqueous ammonium hydroxide to provide an aqueous tobacco extract exhibiting a pH of about 10. The nicotine content of the aqueous tobacco extract so provided is about 0.8 percent.

A Karr Reciprocating Plate Extraction Column as shown generally in FIG. 2 is provided. The column is a Model KC-1-8-XE-SS from Chem-Pro Corp., Fairfield, N. J. The column includes a glass tube having a length of about 2.44 m and an inner diameter of about 2.54 cm. Through the column extends a shaft having a diameter of about 6 mm. On the shaft is positioned about 48 generally circular extraction plates at about 5 cm intervals. The plates are manufactured from stainless steel, have a thickness of about 1.6 mm, have a diameter of slightly less than 5 cm, and have the shape and configuration shown generally in FIG. 3. The movement of the shaft is controlled at a reciprocation of about 200 strokes per minute and a reciprocation amplitude of 1.3 cm by a variable speed drive agitator positioned above the column.

Into the lower input region of the column is fed the aqueous tobacco extract at a rate of about 16.8 pounds per hour. Into the upper input region of the column is fed CFC 11 at a rate of about 25.2 pounds per hour. Feed of each of the aqueous tobacco extract and the CFC 11 is provided by air driven gear pumps. The CFC 11 and the aqueous tobacco extract each are chilled to about 10° C. prior to introduction into the column, in order to prevent the CFC 11 from boiling. In addition, a water cooled coil which surrounds the column maintains the column at a temperature of about 17° C. to about 20° C. The aqueous tobacco extract and the CFC 11 are subjected to a countercurrent extraction process.

The aqueous tobacco extract is removed from the column at the upper output region, and collected in a stainless steel reservoir. The CFC 11 is removed from the column at the lower output region, and is collected in a stainless steel reservoir.

The nicotine content of the aqueous tobacco extract so collected is less than about 0.01 percent. By difference, the nicotine extraction efficiency is above 98 percent. Such resulting denicotinized aqueous tobacco extract then is spray dried in a manner similar to the previously described spray drying process. As such, a substantial quantity of water and essentially all of the ammonia provided as the added ammonium hydroxide are separated from the denicotinized tobacco extract. A dry denicotinized spray dried tobacco extract results.

The CFC 11 and tobacco components therein are subjected to mild distillation conditions at about 30° C., and the CFC 11 distillate is collected. A brown liquid of high viscosity and containing over 60 percent nicotine is isolated.

Another lot (i.e., the retained portion) of the tobacco cut filler blend is placed into the container shown generally in FIG. 4. The container has the shape of a cylinder having a closed bottom and a top which is open to the atmosphere. The container is 28 cm high and 25.5 cm in diameter. A solvent inlet port is positioned along the peripheral face of the container near the bottom of the container, and an extract/solvent exit port is positioned along the peripheral face of the container about 5 cm from the top of the container. A mesh wire screen having a 2.5 mm particle retention is positioned just below the exit port. A small tube having pinhole perforations is positioned along the bottom of the container just below the inlet port. The tube is attached to a laboratory air line.

About 10 l of tap water is provided at ambient temperature and is introduced into the container containing about 800 g of the cut filler. The cut filler has a moisture content of about 12 percent. Then, a further amount of the tap water is provided at ambient temperature and is introduced into the container at a 500 ml/min. rate, for about a 2 hour period. The liquid solvent is introduced into the container using a peristaltic pump. As such, a total of about 60 parts solvent are contacted under ambient conditions with about 1 part cut filler. During contact of the solvent and cut filler, air is bubbled through the pinholes in the small tube into the mixture to effect good turbulence (e.g., and hence mixing) of the mixture, while minimizing degradation of the tobacco cut filler. Air is bubbled through the mixture at such a rate that the mixture appears to be simmering. As such, greater than about 95 percent of available water soluble tobacco components are leached from the tobacco material, and transported out of the container through the exit port.

The processed insoluble tobacco material is removed from the container, and a portion of the aqueous phase which is in contact with the insoluble tobacco material is removed therefrom by manually squeezing the insoluble material through cheesecloth. As such, there is provided a damp, extracted tobacco cut filler having a moisture content of about 78 percent and a predominantly insoluble tobacco material content of about 22 percent.

The damp, extracted tobacco cut filler, which weighs about 1,609 g, is placed into the container shown generally in FIG. 4 and described previously in this Example. The dry weight of the extracted tobacco cut filler is about 354 g. Then, the previously described denicotinized spray dried extract is contacted with tap water to provide a denicotinized aqueous tobacco extract having about 24 parts extract and about 76 parts water. The damp, extracted tobacco cut filler is contacted with about 6,390 g of the denicotinized aqueous tobacco extract for about a 1 hour period. During such contact, air is bubbled through the pinholes in the small tube of the container into the mixture to effect good turbulence of the mixture, while minimizing degradation of the cut filler.

The cut filler is removed from the container, and a portion of the aqueous tobacco extract which is in contact with the insoluble tobacco material is removed therefrom by manually squeezing the insoluble material through cheesecloth. As such, there is provided a damp, processed, deliquored cut filler having a moisture content of about 66 percent, a tobacco extract content of about 17 percent, and an insoluble tobacco material content of about 17 percent. The damp, processed cut filler weighs about 2,123 g. The deliquored cut filler (e.g., a moist cake) is passed twice through a hot air column set at about 150° C. to dry the cut filler to a moisture level of about 28 percent. The cut filler then is air dried at ambient conditions to a moisture level of about 13 percent.

The tobacco filler so provided has a nicotine content of about 0.05 percent, on a dry weight basis. The tobacco filler so processed is used as cut filler in cigarette manufacture. The general physical character of the processed filler is similar to that of the starting tobacco filler which is divided into lots.

EXAMPLE 2

A process for modifying the nicotine content of a tobacco material is performed as follows:

An aged blend of flue-cured, Burley and Oriental tobaccos in cut filler form as described in Example 1 is provided. A portion of the cut filler is extracted, and the extract is spray dried, as described in Example 1. A portion of the spray dried extract is retained for later use; and a portion is processed to provide a denicotinized spray dried extract, in the manner described in Example 1.

The retained portion of cut filler is placed into the container shown generally in FIG. 4 and described in Example 1. The cut filler is extracted with water in the manner described in Example 1.

The processed insoluble tobacco material is removed from the container, and a portion of the aqueous phase which is in contact with the insoluble tobacco material is removed therefrom by manually squeezing the insoluble material through cheesecloth. As such, there is provided a damp, extracted tobacco cut filler having a moisture content of about 79 percent and a predominantly insoluble tobacco material content of about 21 percent.

The damp, extracted tobacco cut filler, which weighs about 1,686 g, is placed into the container shown generally in FIG. 4 and described in Example 1. The dry weight of the extracted tobacco cut filler is about 354 g. Then, about 1,089 g of the previously described spray dried extract and about 336 g of the previously described denicotinized spray dried extract is contacted with tap water to provide a denicotinized aqueous tobacco extract having about 21 parts extract and about 79 parts water. The damp, extracted tobacco cut filler is contacted with about 6,300 g of the aqueous tobacco extract for about a 1 hour period. During such contact, air is bubbled through the pinholes in the small tube of the container into the mixture to effect good turbulence of the mixture, while minimizing degradation of the cut filler.

The cut filler is removed from the container, and a portion of the aqueous tobacco extract which is in contact with the insoluble tobacco material is removed therefrom by manually squeezing the insoluble material through cheesecloth. As such, there is provided a damp, processed, deliquored cut filler having a moisture content of about 70 percent, a tobacco extract content of about 14.5 percent, and an insoluble tobacco material content of about 15.5 percent. The damp, processed cut filler weighs about 2,288 g. The deliquored cut filler (e.g., a moist cake) is passed twice through a hot air column set at about 150° C. to dry the cut filler to a moisture level of about 28 percent. The cut filler then is air dried at ambient conditions to a moisture level of about 13 percent.

The tobacco filler so provided has a nicotine content of about 1.7 percent, on a dry weight basis. The tobacco filler so processed is used as cut filler in cigarette manufacture. The general physical character of the processed filler is similar to that of the starting tobacco filler which is divided into lots.

EXAMPLE 3

A process for producing a very low nicotine content tobacco material and incorporating a desired additive into the tobacco material is performed as follows:

An aged blend of flue-cured, Burley and Oriental tobaccos in cut filler form as described in Example 1 is provided. A portion of the cut filler is extracted, spray dried and processed in the manner described in Example 1, to provide a denicotinized spray dried extract.

Another lot (i.e., the retained portion) of the tobacco cut filler blend is placed into the container shown generally in FIG. 4. The container has the shape of a cylinder having a closed bottom and a top which is open to the atmosphere. The container is about 24 inches high and about 18.5 inches in diameter. A solvent inlet port is positioned along the peripheral face of the container near the bottom of the container, and an extract/solvent exit port is positioned along the peripheral face of the container about 10 inches from the bottom of the container. A mesh wire screen having a 0.5 mm particle retention is positioned just below the exit port. A small tube having pinhole perforations is positioned along the bottom of the container just below the inlet port. The tube is attached to a laboratory air line.

About 10 gallons of tap water is provided at ambient temperature and is introduced into the container containing about 2,370 g of the cut filler. The cut filler has a moisture content of about 12 percent. Then, a further amount of the tap water is provided at ambient temperature and is introduced into the container at a 1 gal./min. rate, for about a 1.5 hour period. As such, a total of about 150 parts solvent are contacted under ambient conditions with about 1 part cut filler. During contact of the solvent and cut filler, air is bubbled through the pinholes in the small tube into the mixture to effect good turbulence (e.g., and hence mixing) of the mixture, while minimizing degradation of the tobacco cut filler. Air is bubbled through the mixture at such a rate that the mixture appears to be simmering. As such, greater than about 95 percent of available water soluble tobacco components are leached from the tobacco material, and transported out of the container through the exit port.

The processed insoluble tobacco material is removed from the container, placed in a perforated basket, and a portion of the aqueous phase which is in contact with the insoluble tobacco material is removed therefrom by applying pressure to the tobacco material using an air cylinder. As such, there is provided a damp, extracted tobacco cut filler having a moisture content of about 78 percent and a predominantly insoluble tobacco material content of about 22 percent.

The damp, extracted tobacco cut filler, which weighs about 4,554 g, is placed into the container shown generally in FIG. 4 and described previously in this Example. The dry weight of the extracted tobacco cut filler is about 1,018 g. Then, the previously described denicotinized spray dried extract and glycerin are contacted with tap water to provide a denicotinized aqueous tobacco extract having about 20 parts extract, about 1 part glycerin and about 79 parts water. The damp, extracted tobacco cut filler is contacted with about 21,793 g of the denicotinized aqueous tobacco extract for about a 1 hour period. During such contact, air is bubbled through the pinholes in the small tube of the container into the mixture to effect good turbulence of the mixture, while minimizing degradation of the cut filler.

The cut filler is removed from the container, and a portion of the aqueous tobacco extract which is in contact with the insoluble tobacco material is removed therefrom as described previously in this example. As such, there is provided a damp, processed, deliquored cut filler having a moisture content of about 68 percent, a tobacco extract content of about 16 percent, and an insoluble tobacco material content of about 16 percent. The damp, processed cut filler weighs about 6,255 g. The deliquored cut filler (e.g., a moist cake) is passed twice through a hot air column set at about 150° C. to dry the cut filler to a moisture level of about 28 percent. The cut filler then is air dried at ambient conditions to a moisture level of about 13 percent.

The tobacco filler so provided has a nicotine content of about 0.07 percent, and a glycerin content of about 3 percent, on a dry weight basis. The tobacco filler so processed is used as cut filler in cigarette manufacture. The general physical character of the processed filler is similar to that of the starting tobacco filler which is divided into lots.

EXAMPLE 4

A process for modifying the nicotine content of a tobacco material by incorporating nicotine into that tobacco material is performed as follows:

An aged blend of flue-cured, Burley and Oriental tobaccos in cut filler form as described in Example 1 is provided. A portion of the cut filler is extracted and spray dried, as described in Example 1.

The retained portion of the cut filler is placed into the container shown generally in FIG. 4 and described in Example 1. The cut filler is extracted with water in the manner described in Example 1. The resulting processed insoluble tobacco material is removed from the container, and a portion of the aqueous phase which is in contact with the insoluble tobacco material is removed therefrom by manually squeezing the insoluble material through cheesecloth. As such, there is provided a damp, extracted tobacco cut filler having a moisture content of about 79 percent and a predominantly insoluble tobacco material content of about 21 percent.

The damp, extracted tobacco cut filler, which weighs about 1,706 g, is placed into the container shown generally in FIG. 4 and described previously in this Example. The dry weight of the extracted tobacco cut filler is about 354 g. Then, the previously described spray dried extract and about 119 g of the high nicotine content liquid isolated from the CFC 11 in Example 1 are contacted with tap water to provide an aqueous tobacco extract having about 21 parts extract and about 79 parts water. The damp, extracted tobacco cut filler is contacted with about 6,300 g of the aqueous tobacco extract for about a 1 hour period. During such contact, air is bubbled through the pinholes in the small tube of the container into the mixture to effect good turbulence of the mixture, while minimizing degradation of the cut filler.

The cut filler is removed from the container, and a portion of the aqueous tobacco extract which is in contact with the insoluble tobacco material is removed therefrom by manually squeezing the insoluble material through cheesecloth. As such, there is provided a damp, processed, deliquored cut filler having a moisture content of about 70 percent, a tobacco extract content of about 15 percent, and an insoluble tobacco material content of about 15 percent. The damp, processed cut filler weighs about 2,404 g. The deliquored cut filler (e.g., a moist cake) is passed twice through a hot air column set at about 150° C. to dry the cut filler to a moisture level of about 28 percent. The cut filler then is air dried at ambient conditions to a moisture level of about 13 percent.

The tobacco filler so provided has a nicotine content of about 5.2 percent, on a dry weight basis. The tobacco filler so processed is used as cut filler in cigarette manufacture. The general physical character of the processed filler is similar to that of the starting tobacco filler which is divided into lots.

EXAMPLE 5

A process for modifying the chemical nature of a tobacco material is performed as follows:

An aged blend of flue-cured, Burley and Oriental tobaccos in cut filler form as described in Example 1 is provided. A portion of the cut filler is extracted with water, and the resulting aqueous extract is spray dried, as described in Example 1. About 15 parts spray dried extract is contacted with about 85 parts water and about 2 parts of a concentrated aqueous ammonia solution. The resulting mixture is maintained at about 10° C. for about 24 hours. The mixture then is spray dried to provide spray dried tobacco extract.

The retained portion of the cut filler is placed in the container shown generally in FIG. 4 and described in Example 1. The cut filler is extracted with water in the manner described in Example 1.

The processed insoluble tobacco material is removed from the container, and a portion of the aqueous phase which is in contact with the insoluble tobacco material is removed therefrom by manually squeezing the insoluble material through cheesecloth. As such, there is provided a damp, extracted tobacco cut filler having a moisture content of about 78 percent and a predominantly insoluble tobacco material content of about 22 percent.

The damp, extracted tobacco cut filler, which weighs about 1,700 g, is placed into the container shown generally in FIG. 4 and described previously in this Example. The dry weight of the extracted tobacco cut filler is about 354 g. Then, the previously described spray dried extract is contacted with tap water to provide an aqueous tobacco extract having about 22 parts extract and about 78 parts water. The damp, extracted tobacco cut filler is contacted with about 6,300 g of the aqueous tobacco extract for about a 1 hour period. During such contact, air is bubbled through the pinholes in the small tube of the container into the mixture to effect good turbulence of the mixture, while minimizing degradation of the cut filler.

The cut filler is removed from the container, and a portion of the aqueous tobacco extract which is in contact with the insoluble tobacco material is removed therefrom by manually squeezing the insoluble material through cheesecloth. As such, there is provided a damp, processed, deliquored cut filler having a moisture content of about 70 percent, a tobacco extract content of about 15 percent, and an insoluble tobacco material content of about 15 percent. The damp, processed cut filler weighs about 2,330 g. The deliquored cut filler (e.g., a moist cake) is passed twice through a hot air column set at about 150° C. to dry the cut filler to a moisture level of about 28 percent. The cut filler then is air dried at ambient conditions to a moisture level of about 13 percent.

EXAMPLE 6

A process for modifying the chemical nature of a tobacco material is performed using essentially the process steps and materials set forth in Example 1, except that the aqueous tobacco extract is subjected to the countercurrent extraction process steps without alteration of the pH (i.e., the aqueous extract at a pH of about 5 is subjected to the countercurrent extraction process steps with CFC 11).

EXAMPLE 7

A process for distributing or re-establishing a tobacco extract within an extracted tobacco material is performed as follows:

An aged blend of flue-cured, Burley and Oriental tobaccos in cut filler form as described in Example 1 is provided. A portion of the cut filler is extracted, and the extract is spray dried, as described in Example 1. The spray dried extract is used as such in later stages of the process.

The retained portion of cut filler is placed into the container shown generally in FIG. 4 and described in Example 1. The cut filler is extracted with water in the manner described in Example 1.

The processed insoluble tobacco material is removed from the container, and a portion of the aqueous phase which is in contact with the insoluble tobacco material is removed therefrom by manually squeezing the insoluble material through cheesecloth. As such, there is provided a damp, extracted tobacco cut filler having a moisture content of about 79 percent and a predominantly insoluble tobacco material content of about 21 percent.

The damp, extracted tobacco cut filler, which weighs about 1,691 g, is placed into the container shown generally in FIG. 4 and described previously in this Example. The dry weight of the extracted tobacco cut filler is about 354 g. Then, the previously described spray dried extract is contacted with tap water to provide an aqueous tobacco extract having about 21 parts extract and about 79 parts water. The damp, extracted tobacco cut filler is contacted with about 6,390 g of the aqueous tobacco extract for about a 1 hour period. During such contact, air is bubbled through the pinholes in the small tube of the container into the mixture to effect good turbulence of the mixture, while minimizing degradation of the cut filler.

The cut filler is removed from the container, and a portion of the aqueous tobacco extract which is in contact with the insoluble tobacco material is removed therefrom by manually squeezing the insoluble material through cheesecloth. As such, there is provided a damp, processed, deliquored cut filler having a moisture content of about 70 percent, a tobacco extract content of about 14.5 percent, and an insoluble tobacco material content of about 15.5 percent. The damp, processed cut filler weighs about 2,314 g. The deliquored cut filler (e.g., a moist cake) is passed twice through a hot air column set at about 150° C. to dry the cut filler to a moisture level of about 28 percent. The cut filler then is air dried at ambient conditions to a moisture level of about 13 percent.

EXAMPLE 8

A process for modifying the chemical nature of a tobacco material, by processing the water insoluble portion of that tobacco material, is performed as follows:

An aged blend of flue-cured, Burley and Oriental tobaccos in cut filler form as described in Example 1 is provided. A portion of the cut filler is extracted, and the extract is spray dried, as described in Example 1.

The retained portion of cut filler which weighs about 600 g, is placed into the container shown generally in FIG. 4 and described in Example 1. The cut filler is extracted with water in the manner described in Example 1. The damp insoluble tobacco material is transferred to another extraction vessel with water, buffered to a pH of about 8 using potassium monobasic phosphate and sodium hydroxide, and maintained at about 50° C. To the resulting mixture is charged about 30 g enzyme EC3.4.21.14 having a specific activity of 2.4 Anson Units/g. The mixture is stirred using a mechanical stirrer, maintained at about 50° C., and maintained at a pH of about 8 for about 3 hours. Then, fresh water is circulated through the vessel to remove water soluble and dispersible decomposed protein fragments.

The processed insoluble tobacco material is removed from the container, and a portion of the aqueous phase which is in contact with the insoluble tobacco material is removed therefrom by manually squeezing the insoluble material through cheesecloth. As such, there is provided a damp, extracted tobacco cut filler having a moisture content of about 78 percent and a predominantly insoluble tobacco material content of about 22 percent.

The damp, extracted deproteinated tobacco cut filler, which weighs about 1,084 g, is placed into the container shown generally in FIG. 4 and described previously in this Example. The dry weight of the extracted tobacco cut filler is about 240 g. Then, the previously described spray dried extract is contacted with tap water to provide an aqueous tobacco extract having about 22 parts extract and about 78 parts water. The damp, extracted tobacco cut filler is contacted with about 6,116 g of the aqueous tobacco extract for about a 1 hour period. During such contact, air is bubbled through the pinholes in the small tube of the container into the mixture to effect good turbulence of the mixture, while minimizing degradation of the cut filler.

The cut filler is removed from the container, and a portion of the aqueous tobacco extract which is in contact with the insoluble tobacco material is removed therefrom by manually squeezing the insoluble material through cheesecloth. As such, there is provided a damp, processed, deliquored cut filler having a moisture content of about 70 percent, a tobacco extract content of about 16 percent, and an insoluble tobacco material content of about 14 percent. The damp, processed cut filler weighs about 1,672 g. The deliquored cut filler (e.g., a moist cake) is passed twice through a hot air column set at about 150° C. to dry the cut filler to a moisture level of about 28 percent. The cut filler then is air dried at ambient conditions to a moisture level of about 13 percent.

EXAMPLE 9

A process for modifying the character of a tobacco material is performed as follows:

An aged blend of flue-cured, Burley and Oriental tobaccos in cut filler form as described in Example 1 is provided. A portion of the cut filler is extracted, as described in Example 1.

The retained portion of the cut filler is placed into the container shown generally in FIG. 4 and described in Example 3. The cut filler is extracted with water in the manner described in Example 3. The resulting processed insoluble tobacco material is removed from the container, and a portion of the aqueous phase which is in contact with the insoluble tobacco material is removed therefrom as described in Example 3. As such, there is provided a damp, extracted tobacco cut filler having a moisture content of about 79 percent and a predominantly insoluble tobacco material content of about 21 percent.

The damp, extracted tobacco cut filler, which weighs about 3,426 g, is placed into the container shown generally in FIG. 4 and described in Example 3. The dry weight of the extracted tobacco cut filler is about 710 g. Then, about 182 g of the high nicotine content liquid of the type isolated from the CFC 11 in Example 1 is contacted with tap water to provide an aqueous tobacco extract having about 22 parts extract and about 78 parts water. The damp, extracted tobacco cut filler is contacted with about 8,600 g of the aqueous tobacco extract for about a 1 hour period. During such contact, air is bubbled through the pinholes in the small tube of the container into the mixture to effect good turbulence of the mixture, while minimizing degradation of the cut filler.

The cut filler is removed from the container, and a portion of the aqueous tobacco extract which is in contact with the insoluble tobacco material is removed therefrom as described in Example 3. As such, there is provided a damp, processed, deliquored cut filler having a moisture content of about 81 percent, a tobacco extract content of about 1.5 percent, and an insoluble tobacco material content of about 17.5 percent. The damp, processed cut filler weighs about 4,010 g. The deliquored cut filler (e.g., a moist cake) is passed twice through a hot air column set at about 150° C. to dry the cut filler to a moisture level of about 28 percent. The cut filler then is air dried at ambient conditions to a moisture level of about 13 percent.

The tobacco filler so provided has a nicotine content of about 4 percent, on a dry weight basis. The tobacco filler so processed is used as cut filler in cigarette manufacture.

EXAMPLE 10

A process for modifying the nicotine content of a tobacco material is performed as follows:

An aged blend of flue-cured, Burley and Oriental tobaccos having a dry weight nicotine content of about 2.3 percent and described in Example 1 is provided, except that the blend is in cut filler form shredded at about 25 cuts per inch. A portion of the cut filler is extracted and spray dried, as described in Example 1. A portion of the spray dried extract is retained for later use; and a portion is processed to provide a denicotinized extract and a high nicotine content liquid isolated from the CFC 11, the manner described in Example 1.

The retained portion, which weighs about 3,500 g, is placed into the container shown generally in FIG. 4 and described in Example 3, except that the outlet portion is positioned about 20 inches from the bottom of the container. The container is then filled to the outlet port with water, and the cut filler is extracted with tap water by introducing water into the container at 1 gal./min. rate for about a 1.5 hour period, in the manner described in Example 3.

The processed insoluble tobacco material is removed from the container, and a portion of the aqueous phase is removed therefrom, as described in Example 3. As such, there is provided a damp, extracted tobacco cut filler, which weighs about 6,802 g. The damp, extracted cut filler is placed into the container shown generally in FIG. 4 and described previously in this Example. The dry weight of the extracted tobacco cut filler is about 1,514 g. Then, about 7,289 g of the previously described spray dried extract, about 335 g of the high nicotine content liquid and about 419 g glycerin are contacted with about 25,128 g tap water to provide an aqueous tobacco extract. The damp, extracted tobacco cut filler is contacted with about aqueous tobacco extract for about a 0.5 hour period. During such contact, air is bubbled through the pinholes in the small tube of the container into the mixture to effect good turbulence of the mixture, while minimizing degradation of the cut filler.

The cut filler is removed from the container, and a portion of the aqueous tobacco extract which is in contact with the insoluble tobacco material is removed therefrom as described in Example 3. As such, there is provided a damp, processed, deliquored cut filler. The damp, processed cut filler weighs about 10,478 g. The deliquored cut filler (e.g., a moist cake) is passed twice through a hot air column set at about 150° C. to dry the cut filler to a moisture level of about 28 percent. The cut filler then is air dried at ambient conditions to a moisture level of about 13 percent.

The tobacco filler so provided has a nicotine content of about 3.9 percent, and a glycerin content of about 3 percent, on a dry weight basis. The tobacco filler so processed is used as cut filler in cigarette manufacture. The general physical character of the processed filler is similar to that of the starting tobacco filler which is divided into lots.

EXAMPLE 11

A process for incorporating a salt into a tobacco material is performed as follows:

An aged blend of flue-cured, Burley and Oriental tobaccos in cut filler form as described in Example 10 is provided. The blend has a nitrate content of about 0.67 percent. A portion of the cut filler is extracted and spray dried, as described in Example 10.

The retained portion of the cut filler, which weighs about 1,362 g is placed into the container shown generally in FIG. 4 and described in Example 3. The cut filler is extracted with water in the manner described in Example 3. The resulting processed insoluble tobacco material is removed from the container, and a portion of the aqueous phase which is in contact with the insoluble tobacco material is removed therefrom as described in Example 3. As such, there is provided a damp, extracted tobacco cut filler.

The damp, extracted tobacco cut filler, which weighs about 2,746 g, is placed into the container shown generally in FIG. 4 and described in Example 3. Then, about 2,694 g spray dried extract, about 111 g potassium nitrate and about 111 g glycerin are contacted with about 9,951 g tap water to provide an aqueous tobacco extract. The damp, extracted tobacco cut filler is contacted with the aqueous tobacco extract for about a 1 hour period. During such contact, air is bubbled through the pinholes in the small tube of the container into the mixture to effect good turbulence of the mixture, while minimizing degradation of the cut filler.

The cut filler is removed from the container, and a portion of the aqueous tobacco extract which is in contact with the insoluble tobacco material is removed therefrom as described in Example 3. As such, there is provided a damp, processed, deliquored cut filler. The damp, processed cut filler weighs about 4,077 g. The deliquored cut filler (e.g., a moist cake) is passed twice through a hot air column set at about 150° C. to dry the cut filler to a moisture level of about 28 percent. The cut filler then is air dried at ambient conditions to a moisture level of about 13 percent.

The tobacco filler so provided has a nitrate content of about 1.7 percent, on a dry weight basis. The tobacco filler so processed is used as cut filler in cigarette manufacture.

EXAMPLE 12

A process for incorporating a tobacco extract into a tobacco material is performed as follows:

An aged blend of flue-cured, Burley and Oriental tobaccos in cut filler form as described in Example 10 is provided. A portion of the cut filler is extracted and spray dried, as described in Example 10.

The retained portion of the cut filler, which weighs about 2,270 g, is placed into the container shown generally in FIG. 4 and described in Example 3. The cut filler is extracted with water in the manner described in Example 3. The resulting processed insoluble tobacco material is removed from the container, and a portion of the aqueous phase which is in contact with the insoluble tobacco material is removed therefrom as described in Example 3. As such, there is provided a damp, extracted tobacco cut filler.

The damp, extracted tobacco cut filler, which weighs about 4,560 g, is placed into the container shown generally in FIG. 4 and described in Example 3. Then, about 6,450 g spray dried extract and about 222 g glycerin are contacted with 17,000 g tap water to provide an aqueous tobacco extract. The damp, extracted tobacco cut filler is contacted with the aqueous tobacco extract for about a 1 hour period. During such contact, air is bubbled through the pinholes in the small tube of the container into the mixture to effect good turbulence of the mixture, while minimizing degradation of the cut filler.

The cut filler is removed from the container, and a portion of the aqueous tobacco extract which is in contact with the insoluble tobacco material is removed therefrom as described in Example 1. As such, there is provided a damp, processed, deliquored cut filler. The damp, processed cut filler weighs about 6,521 g. The deliquored cut filler (e.g., a moist cake) is passed twice through a hot air column set at about 150° C. to dry the cut filler to a moisture level of about 28 percent. The cut filler then is air dried at ambient conditions to a moisture level of about 13 percent.

The tobacco filler so processed is used as cut filler in cigarette manufacture.

What is claimed is:

1. A process for altering the character of tobacco material, the process comprising the steps of:

(a) providing extracted tobacco material by extracting tobacco material using a liquid extraction solvent and separating tobacco material not extracted by the solvent from the solvent and tobacco extract extracted by the solvent;

(b) providing a tobacco extract by extracting tobacco material using a liquid extraction solvent, thereby providing a tobacco extract within the extraction solvent;

(c) contacting the tobacco extract provided in step (b) within liquid extraction solvent with the extracted tobacco material provided in step (a) thereby providing a mixture of solvent, tobacco extract and extracted tobacco material; the mixture (i) including a weight of tobacco extractables greater than that weight of tobacco extract separated from the tobacco material in step (a), and (ii) including about 5 to about 40 percent extractables, based on the total weight of the solvent and tobacco extractables within the mixture;

(d) separating the extracted tobacco material from a portion of the solvent and tobacco extract, thereby providing a mixture of solvent, tobacco extract and extracted tobacco material; the mixture thereby having a solvent content ranging from about 60 to about 90 weight percent, based on the total weight thereof; and (e) separating at least a portion of the solvent from the mixture provided in step (d).

2. The process of claim 1 further including altering the chemical composition of the extract provided in step (b).

3. The process of claim 1 whereby at least one additive is incorporated into the extract provided in step (b).

4. The process of claim 3 whereby the solvent is a liquid having an aqueous character, and the selected substance includes nicotine.

5. The process of claim 3 whereby at least one selected substance is removed from the tobacco extract provided in step (b).

6. The process of claim 5 whereby the solvent is a liquid having an aqueous character, and the selected substance includes nicotine.

7. The process of claim 1, 2, 3 or 5 further including altering the chemical composition of the extracted tobacco material provided in step (a).

8. The process of claim 7 whereby the amount of tobacco extractables within the mixture provided in step (c) ranges from about 10 to about 30 percent, based on the total weight of the solvent and tobacco extractables within the mixture.

9. The process of claim 7 whereby the amount of tobacco extractables within the mixture provided in step (c) ranges from about 15 to about 25 percent, based on the total weight of the solvent and tobacco extractables within the mixture.

10. The process of claim 7 whereby the solvent content of the mixture provided in step (d) ranges from about 65 to about 85 weight percent, based on the total weight of that mixture.

11. The process of claim 7 whereby the solvent is a liquid having an aqueous character, and sufficient solvent is separated from the mixture in step (e) to provide a mixture of tobacco extract and extracted tobacco material having a solvent content between about 10 and about 15 weight percent.

12. The process of claim 1, 2, 3 or 5 whereby the solvent is a liquid having an aqueous character.

13. The process of claim 12 whereby the liquid having an aqueous character is greater than 90 weight percent water.

14. The process of claim 1, 2, 3 or 5 whereby the amount of tobacco extractables within the mixture provided in step (c) ranges from about 10 to about 30 percent, based on the total weight of the solvent and tobacco extractables within the mixture.

15. The process of claim 1, 2, 3 or 5 whereby the amount of tobacco extractables within the mixture provided in step (c) ranges from about 15 to about 25 percent, based on the total weight of the solvent and tobacco extractables within the mixture.

16. The process of claim 1, 2, 3 or 5 whereby the solvent content of the mixture provided in step (d) ranges from about 65 to about 85 weight percent, based on the total weight of that mixture.

17. The process of claim 1, 2, 3 or 5 whereby the solvent is a liquid having an aqueous character, and sufficient solvent is separated from the mixture in step (e) to provide a mixture of tobacco extract and extracted tobacco material having a solvent content between about 10 and about 15 weight percent.

18. The process of claim 1 whereby the solvent is a liquid having an aqueous character, and the tobacco extract provided in step (b) is provided in a spray dried form prior to step (c).

19. A process for altering the character of tobacco material, the process comprising the steps of:

(a) providing extracted tobacco material by extracting tobacco material using a liquid extraction solvent and separating tobacco material not extracted by the solvent from the solvent and tobacco extract extracted by the solvent;

(b) providing a tobacco extract by extracting tobacco material using a liquid extraction solvent, thereby providing a tobacco extract within the extraction solvent;

(c) contacting the tobacco extract provided in step (b) within liquid extraction solvent with the extracted tobacco material provided in step (a) thereby providing a mixture of solvent, tobacco extract and extracted tobacco material; the weight of solvent within the mixture being more than 3 times that of the weight of the extracted tobacco material within the mixture;

(d) separating the extracted tobacco material from a portion of the solvent and tobacco extract, thereby providing a mixture of solvent, tobacco extract and extracted tobacco material; the mixture thereby having a solvent content of at least about 60 percent based on the total weight thereof; and (e) separating at least a portion of the solvent from the mixture provided in step (d).

20. The process of claim 19 whereby the weight of the solvent within the mixture provided in step (c) is more than about 6 times that weight of the extracted tobacco material within the mixture.

21. The process of claim 19 whereby the weight of the solvent within the mixture provided in step (c) is more than about 10 times that weight of the extracted tobacco material within the mixture.

22. The process of claim 21 further including altering the chemical composition of the extract provided in step (b).

23. The process of claim 21 whereby at least one additive is incorporated into the extract provided in step (b).

24. The process of claim 21 or 23 whereby at least one selected substance is removed from the tobacco extract provided in step (b).

25. The process of claim 21 further including altering the chemical composition of the extracted tobacco material provided in step (a).

26. The process of claim 21 whereby the solvent is a liquid having an aqueous character.

27. The process of claim 26 whereby the liquid having an aqueous character is greater than 90 weight percent water.

28. The process of claim 21 whereby the solvent is a liquid having an aqueous character, and sufficient solvent is separated from the mixture in step (e) to provide a mixture of tobacco extract and extracted tobacco material having a solvent content between about 10 and about 15 weight percent.

29. The process of claim 19 whereby the weight of the solvent within the mixture provided in step (c) is more than about 15 times that weight of the extracted tobacco material within the mixture.

30. The process of claim 21 or 29 whereby the solvent content of the mixture provided in step (d) ranges from about 60 to about 90 weight percent, based on the total weight of that mixture.

31. The process of claim 30 whereby the solvent is a liquid having an aqueous character, and sufficient solvent is separated from the mixture in step (e) to provide a mixture of tobacco extract and extracted tobacco material having a solvent content between about 10 and about 15 weight percent.

32. The process of claim 21 or 29 whereby the solvent content of the mixture provided in step (d) ranges from about 65 to about 85 weight percent, based on the total weight of that mixture.

33. The process of claim 19 whereby the solvent is a liquid having an aqueous character, and the tobacco extract provided in step (b) is provided in a spray dried form prior to step (c).

34. A process for removing at least one selected substance from tobacco material, the process comprising the steps of:

(a) providing extracted tobacco material by extracting tobacco material using a liquid extraction solvent and separating tobacco material not extracted by the solvent from the solvent and tobacco extract extracted by the solvent;

(b) providing a processed tobacco extract by (i) extracting tobacco material using a liquid extraction solvent, thereby providing a tobacco extract within the extraction solvent, and (ii) removing at least one selected substance from the tobacco extract;

(c) contacting the processed tobacco extract within liquid extraction solvent with the extracted tobacco material provided in step (a) thereby providing a mixture of solvent, tobacco extract and extracted tobacco material; the mixture (i) including a weight of tobacco extractables greater than that weight of tobacco extract separated from the tobacco material in step (a), and (ii) including about 5 to about 40 percent tobacco extractables, based on the total weight of the solvent and tobacco extractables within the mixture;

(d) separating the extracted tobacco material from a portion of the solvent and tobacco extract, thereby providing a mixture of solvent, tobacco extract and extracted tobacco material; the mixture having a solvent content of about 60 to about 90 weight percent, based on the total weight thereof; and (e) separating at least a portion of the solvent from the mixture provided in step (d).

35. The process of claim 34 whereby the amount of processed tobacco extract within extraction solvent ranges from about 10 to about 30 percent, based on the total weight of the extract and solvent.

36. The process of claim 34 whereby the amount of processed tobacco extract within extraction solvent ranges from about 15 to about 25 percent, based on the total weight of the extract and solvent.

37. The process of claim 34 whereby the solvent content of the mixture provided in step (d) ranges from about 65 to about 85 percent, based on the total weight of the solvent, tobacco extract and tobacco material insoluble in the solvent.

38. The process of claim 34 whereby the extraction solvent is a liquid having an aqueous character.

39. The process of claim 34 whereby the selected substance includes nicotine.

40. The process of claim 34 whereby the solvent is a solvent having an aqueous character, and sufficient solvent is separated from the mixture in step (e) to provide a mixture of tobacco extract and tobacco material insoluble in the solvent having a moisture level between about 10 and about 15 weight percent.

41. The process of claim 34 whereby the solvent is a liquid having an aqueous character, and the processed tobacco extract provided in step (b) is provided in spray dried form prior to step (c).

* * * * *